United States Patent [19]

Troxler et al.

[11] Patent Number: 4,752,017

[45] Date of Patent: Jun. 21, 1988

[54] TENSIONING DEVICE FOR SLIDING GATES

[75] Inventors: Beat Troxler, Hildisrieden; Karl B. Rietmann, Zurich, both of Switzerland

[73] Assignee: Stopinc Aktiengesellschaft, Baar, Switzerland

[21] Appl. No.: 44,277

[22] PCT Filed: May 30, 1986

[86] PCT No.: PCT/EP86/00325

§ 371 Date: Mar. 19, 1987

§ 102(e) Date: Mar. 19, 1987

[87] PCT Pub. No.: WO87/00780

PCT Pub. Date: Feb. 12, 1987

[30] Foreign Application Priority Data

Aug. 8, 1985 [DE] Fed. Rep. of Germany ..... 3528431

[51] Int. Cl.[4] ..... B65D 43/20

[52] U.S. Cl. ..... 220/348; 222/512

[58] Field of Search ..... 220/345–348; 222/512, 561

[56] References Cited

U.S. PATENT DOCUMENTS 3,765,579 10/1973 Cramer ..... 222/512

4,538,729 9/1985 Ackeret ..... 220/348

*Primary Examiner*—George T. Hall

*Attorney, Agent, or Firm*—Wenderoth, Lind & Ponack

[57] ABSTRACT

A tensioning device for a sliding gate on the nozzle of a metallurgical vessel includes, for the spring mounting of the tensioning device between a gate housing and a housing cover by means of clamping units that connect such two members and that are hinged to the housing and cross under housing cover 30, bending springs as hinging shafts for clamping units. This results in a simple construction of the tensioning device due to the two modes of operation of the bending springs.

6 Claims, 1 Drawing Sheet

TENSIONING DEVICE FOR SLIDING GATES

BACKGROUND OF THE INVENTION

The invention relates to a tensioning device for a sliding gate provided on the nozzle of a vessel containing molten metal, the sliding gate including a housing, a bottom plate permanently installed therein, a sliding plate adjustably mounted in a housing cover and sealingly and resiliently pressed against the bottom plate by means of clamping units hinged to the housing and crossing under the housing cover.

In a sliding gate of the prior art disclosed in Swiss Patent CH-PS No. 639 301 and of the type described above, the tensioning of the sliding plate against the bottom plate occurs via adjusting screw means which are distributed over the circumferential sides and act on the housing and on the cover and, upon being tightened, produce a surface pressure on the sliding plate. The adjusting screw means each have a screw bolt pivotally suspended on a hinging shaft acting as a clamping unit, a threadless sleeve crossed under the housing cover, a lock nut and cup springs inserted between sleeve and nut. In order to be able to produce the required adjustable surface pressure, these cup springs require a rather elaborate and exact fabrication. In addition, it has been shown in practice that cup springs are sensitive and frequently cause defects. Admittedly, a collar provided on the sleeve must protect the springs against external effects,.such as heat and dust accumulation, but this will prevent visual inspection of the condition of the springs.

SUMMARY OF THE INVENTION

The invention is directed toward the improvement of the spring action on the clamping units hinged to the housing.

According to the invention, this object is achieved by designing the hinging shafts of the clamping units as bending or flexure springs. This bending spring, for example, in the form of a simple, oblong leaf spring, a torsion rod spring, or a leaf consisting of laminated spring leaves can be adjusted with a high degree of accuracy to the required tensioning force between gate housing and housing cover. Such springs can easily be mounted or dismounted and at the same time satisfy two functions: on the one hand, the cushioning of the housing cover on the housing and, on the other hand, the hinging of the clamping units. In addition, the bending springs can be inspected without difficulty due to their uncluttered arrangement.

Preferably, the bending springs are mounted at both ends thereof in the gate housing and support at least one clamping means formed as an eyebolt with lock nut and are locked against lateral movement. Laminated leaf springs have proven suitable for use as a bending spring and are appropriately locked at one end by a transverse bolt and are held in a bushing, while the other end has a free seating in the longitudinal direction in order not to be subjected to additional tensile stresses. Here, the bushing can be locked on the housing by means of an adjusting bolt in two opposing directions of deflection of a bending spring, which, when required, can be turned around from a used to the still unused deflection side. Each bending spring is locked against excessive deflection by a stop means provided on the gate housing. The same kind of stop means prevent the eyebolts supported by the bending springs from moving sideways.

For linear sliding gates it is particularly useful to provide two coaxial bending springs, each with a clamping unit, on each of the opposite long sides of the housing.

BRIEF DESCRIPTION OF THE DRAWINGS

The invention will now be described with reference to the accompanying drawing; wherein.

DETAILED DESCRIPTION OF THE INVENTION

Figure 1:
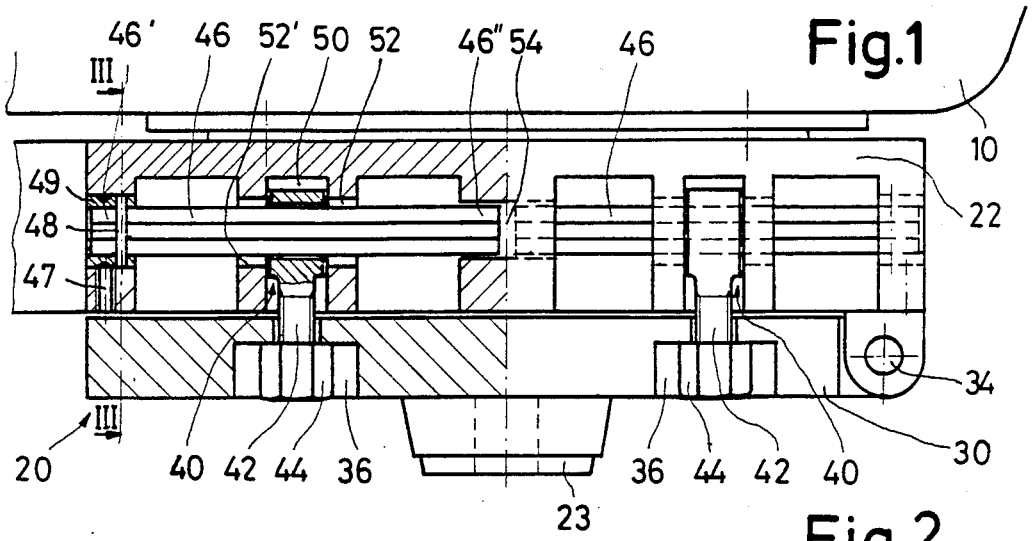
FIG. 1 is a side view partially in section; of a sliding gate fitted out according to the invention.
Figure 2:
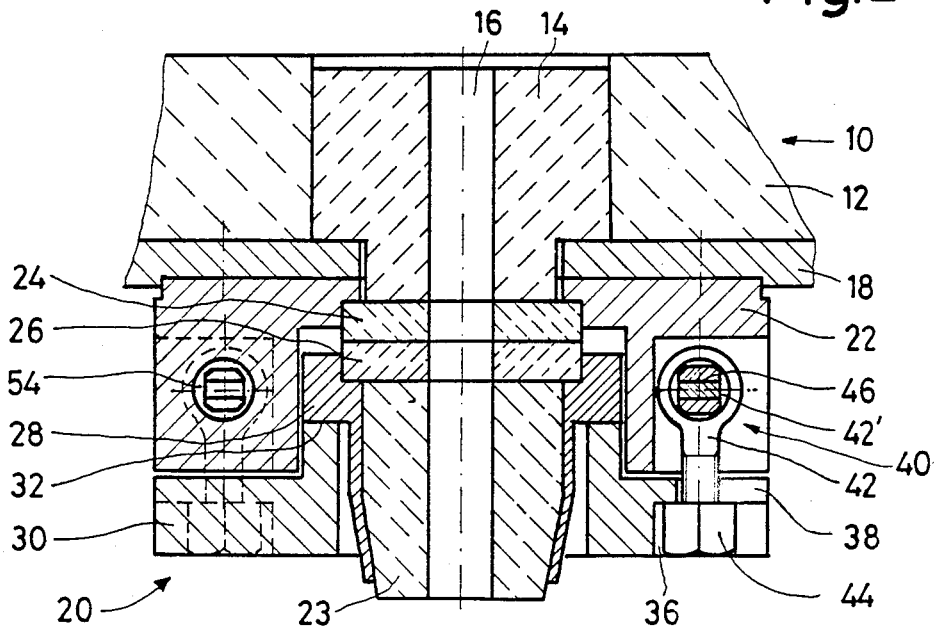
FIG. 2 is a transverse section through the sliding gate in FIG. 1, a tensioning device being shown in elevation.

FIGS. 1 and 2 show a conventional sliding gate 20, not described in great detail hereinafter, secured to a partially illustrated vessel 10 for molten metal. Vessel 10 essentially consists of a steel jacket 18, a refractory lining 12 and a nozzle sleeve 14 with a nozzle orifice 16 which, in the opening position of gate 20 is extended through the sliding gate.

Sliding gate 20 secured to steel jacket 18 of vessel 10 essentially consists of a housing 22 attached by screws to steel jacket 18, a refractory bottom plate 24 placed in housing 22 and adjoining nozzle sleeve 14, a refractory sliding plate 26 sealingly abutting against bottom plate 24, a longitudinally moving sliding frame 28 holding a nozzle sleeve 23 and sliding plate 26, as well as a closing housing cover 30 with guides 32 for frame 28 and tensioning devices 40 to fasten housing cover 30 to the housing. Housing 22 and cover 30 are connected via a hinge joint 34.

Tensioning devices 40 each consist of a bending or flexure spring 46 supported at opposite ends thereof and formed as leaf springs, and a clamping unit in the form of an eyebolt 42 provided with a lock nut 44 and suspended approximately in the middle of bending spring 46. Spring 46 is rounded off at its longitudinal edges in order to enable eyebolt 42 to swing through 90°. Eyebolts 42 are prevented from moving sideways by plane walls of recesses 50 in housing 22. Other recesses 36 and 38 arranged in housing cover 30 enable the eyebolts to retract under housing cover 30 for proper tensioning clamping of housing 22 and housing cover 30.

Figure 3:
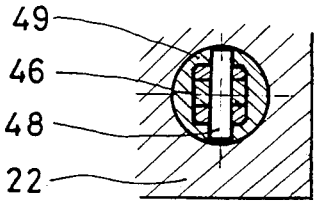
FIG. 3 is a partial cross-sectional view of the sliding gate in FIG. 1 taken along the line III—III.

In gate housing 22 are provided two bending springs 46 on each long side of gate 20. Each bending springs 46 extends over half the side length and is mounted by two ends 46' and 46'' in housing 22. As can best be seen in FIG. 3, the point of support is at the outer end 46' by means of a bushing 49 with transverse bolt 48, while the inner end 46'' can move freely in the longitudinal direction in profiled openings 54. Bushing 49 itself is held by a adjusting bolt 47 screwed into housing 22 and can be rotated 180° when bending spring 46 has undergone a permanent deformation in the direction of the load. Furthermore, the deflection of bending spring 46 is limited by housing stops 52' provided in passages 52 flanking recess 50.

Other variants not shown may be contemplated. For example, each long side of the gate may include only one longitudinally extending spring 46 with two clamping units or eyebolts 42, 44. Moreover, three and more clamping units 42, 44 may be used for a gate side, possibly with bending springs 46 staggered one above the other. Bending springs 46 may also be formed as torsion spring rods.

Similarly, in another possible variant not shown, the spring elements may be fixed laterally in the housing cover, while the clamping units may also be pivotally suspended on these spring elements. In this case, appropriate recesses in the housing enable tightening of the cover on the housing.

We claim:

1. In a tensioning device for a sliding gate provided on the nozzle of a vessel containing molten metal, the sliding gate including a housing, a bottom plate permanently installed therein, and a sliding plate sealingly abutting against the bottom plate and adjustably mounted in a housing cover and resiliently pressed against the bottom plate by means of clamping units hinged about shafts to the housing and crossing under the housing cover, the improvement wherein said hinging shafts of the clamping units are formed as bending springs.

2. The device as set forth in claim 1, wherein each said bending spring is mounted at both ends in the housing and supports at least one clamping unit formed as an eyebolt with lock nut and locked against lateral movement.

3. The device as set forth in claim 2, wherein said bending spring comprises a laminated leaf spring with a rectangular profile and having one end is locked in a bushing by a transverse bolt and another held to move freely in the longitudinal direction.

4. The device as set forth in claim 3, wherein said can be locked into position on the housing by means of an adjusting bolt in two opposing directions of deflection of said bending spring.

5. The device as set forth in claim 3, wherein said in that the bending springs (46) are locked against excessive deflection and the eyebolts supported thereby are prevented from moving sideways by stop means formed from recesses or passages of the housing.

6. The device as set forth in claim 1, more particularly for a linear sliding gate, wherein each of two opposite long sides of the housing have two coaxial bending springs each having one clamping unit each.

* * * * *